US007682216B2

(12) United States Patent
Spector

(10) Patent No.: US 7,682,216 B2
(45) Date of Patent: Mar. 23, 2010

(54) BOOK HOUSING A FIGURE OF COMPRESSED FOAM

(76) Inventor: Donald Spector, 641 Fifth Ave., New York, NY (US) 10022

( * ) Notice: Subject to any disclaimer, the term of this patent is extended or adjusted under 35 U.S.C. 154(b) by 276 days.

(21) Appl. No.: 11/427,560

(22) Filed: Jun. 29, 2006

(65) Prior Publication Data

US 2008/0003919 A1 Jan. 3, 2008

(51) Int. Cl.
*A63H 33/38* (2006.01)
*A63H 33/00* (2006.01)

(52) U.S. Cl. ..... 446/147; 446/148; 446/71; 472/51; 281/31

(58) Field of Classification Search ..... 446/147–152, 446/308–311, 373, 385, 486, 71–73, 75–76; 472/51, 54; 281/31, 32, 51
See application file for complete search history.

(56) References Cited

U.S. PATENT DOCUMENTS 1,490,295 A * 4/1924 Stephens ..... 434/178
3,583,729 A * 6/1971 De Groot ..... 281/31
4,054,204 A 10/1977 Keeton
4,853,994 A * 8/1989 Ekstein ..... 5/639
5,181,901 A 1/1993 Volkert
5,897,418 A 4/1999 Spector
5,951,355 A * 9/1999 Dana et al. ..... 446/73
6,155,904 A * 12/2000 Spector ..... 446/320
6,257,621 B1 * 7/2001 Smith ..... 281/15.1
6,364,360 B1 4/2002 Kaufman
6,390,507 B1 5/2002 Derraugh et al.
6,494,759 B1 12/2002 Polick
6,575,807 B2 6/2003 Spector
6,712,396 B2 3/2004 Derraugh
6,929,526 B1 8/2005 Cole et al.

* cited by examiner

*Primary Examiner*—Kien T Nguyen
(74) *Attorney, Agent, or Firm*—Collard & Roe, P.C.

(57) ABSTRACT

An article including a book, a closeable housing and an object in a compressed state in the housing is disclosed. The object is compressed foam that expands into a figure when the housing is opened. The book has one or more characters and the figure is representative of one of the one or more characters. The housing is preferably in a back cover of the book. The compressible toy is made from a compressible and expandable foam.

8 Claims, 4 Drawing Sheets

BOOK HOUSING A FIGURE OF COMPRESSED FOAM

BACKGROUND OF THE INVENTION

The present invention relates to an article and a method for toys. More specifically it relates to books and providing a toy figure which represents a character that is included in the book.

The experience of reading a book or being read from a book can be enhanced by providing a pop up figure in the book that represents a character from the book. These pop up figures, however, lack realism. Further, the pop up figures are not meant to be removed from the book.

In general, a parent needs to buy books and toy figures as separate items. Usually, a toy figure related to a book is obtained after reading a book, thus not optimally enhancing the opportunity for a reader to identify with a character of a book.

Accordingly new articles and methods are required that will improve the experience of reading a book.

SUMMARY OF THE INVENTION

In accordance with one aspect of the present invention, an article is provided. The article includes a book, a closeable housing and an object in a compressed state in the housing. When the housing is opened, the object expands into a figure.

In accordance with a further aspect of the present invention, the book has one or more characters and the figure is representative of one of the one or more characters.

In accordance with another aspect of the present invention, the housing is closed by a strap that has a Velcro connection on it.

In accordance with another aspect of the present invention, the housing is located in a back cover of the book. The housing is preferably decorated with a picture related to a content of the book.

The compressible figure is preferably made from a compressible and expandable foam. In accordance with another embodiment of the present invention, the compressible figure includes a spring that is loaded when the object is in the compressed state.

A method is provided in accordance with another aspect of the present invention. The method preferably includes the steps of reading a book with a closeable housing, opening the closeable housing and expanding a compressed object into a figure. Once the housing has been opened and the compressed object has expanded into a figure, the figure can be removed from the book and played with. The figure is preferably shaped and decorated to correspond to a character in the book.

DESCRIPTION OF A PREFERRED EMBODIMENT

Figure 1:
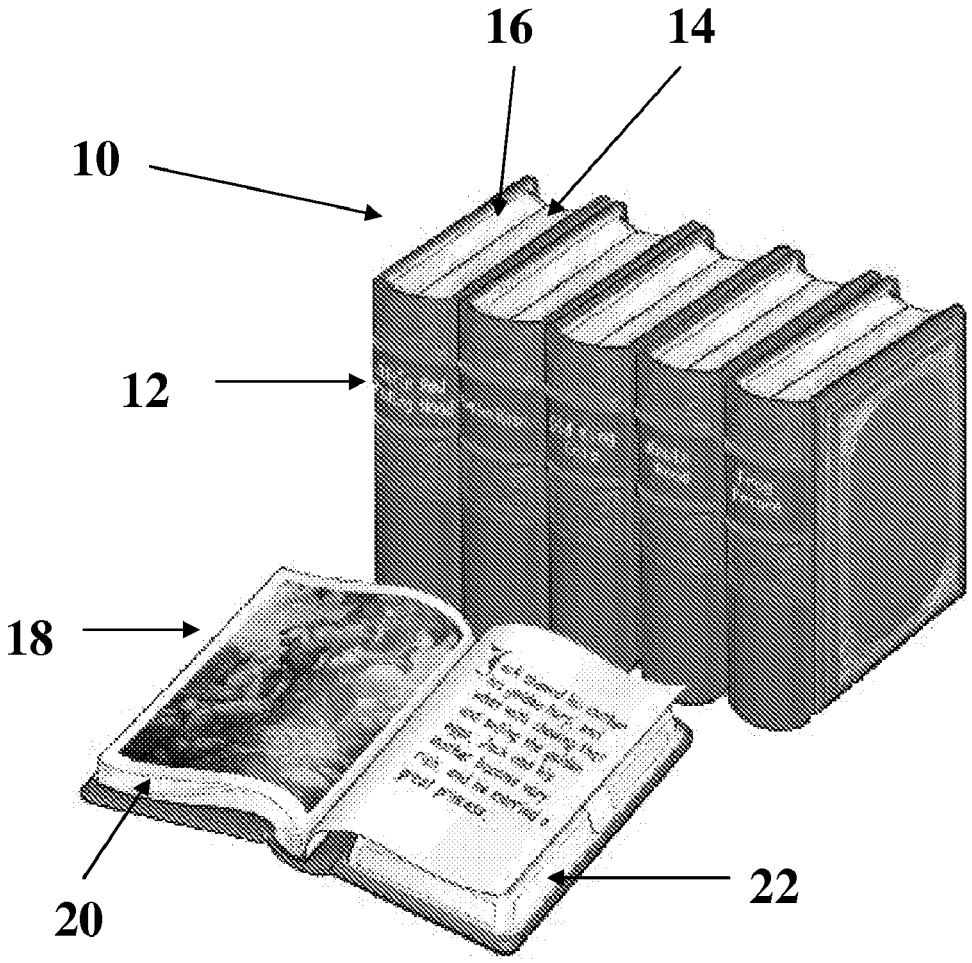
FIG. 1 illustrates a collection of books in accordance with one aspect of the present invention.

FIG. 1 illustrates a collection of books 10. Each individual book 12 has a plurality of pages 12 containing the story to be read. Each individual book 12 also has a closeable housing 16. The collection of books 10 may be a series of related books. For example, the collection of books 10 could be a series of stories about a Disney character such as Mickey Mouse.

One of the books 18 is illustrated in an open position. The book 18 has pages 20 just like any other book. A reader turns the pages from right to left as the book 18 is read. When the book is completed, and the last page is turned, a closeable housing 22 is exposed to the reader.

Figure 2:
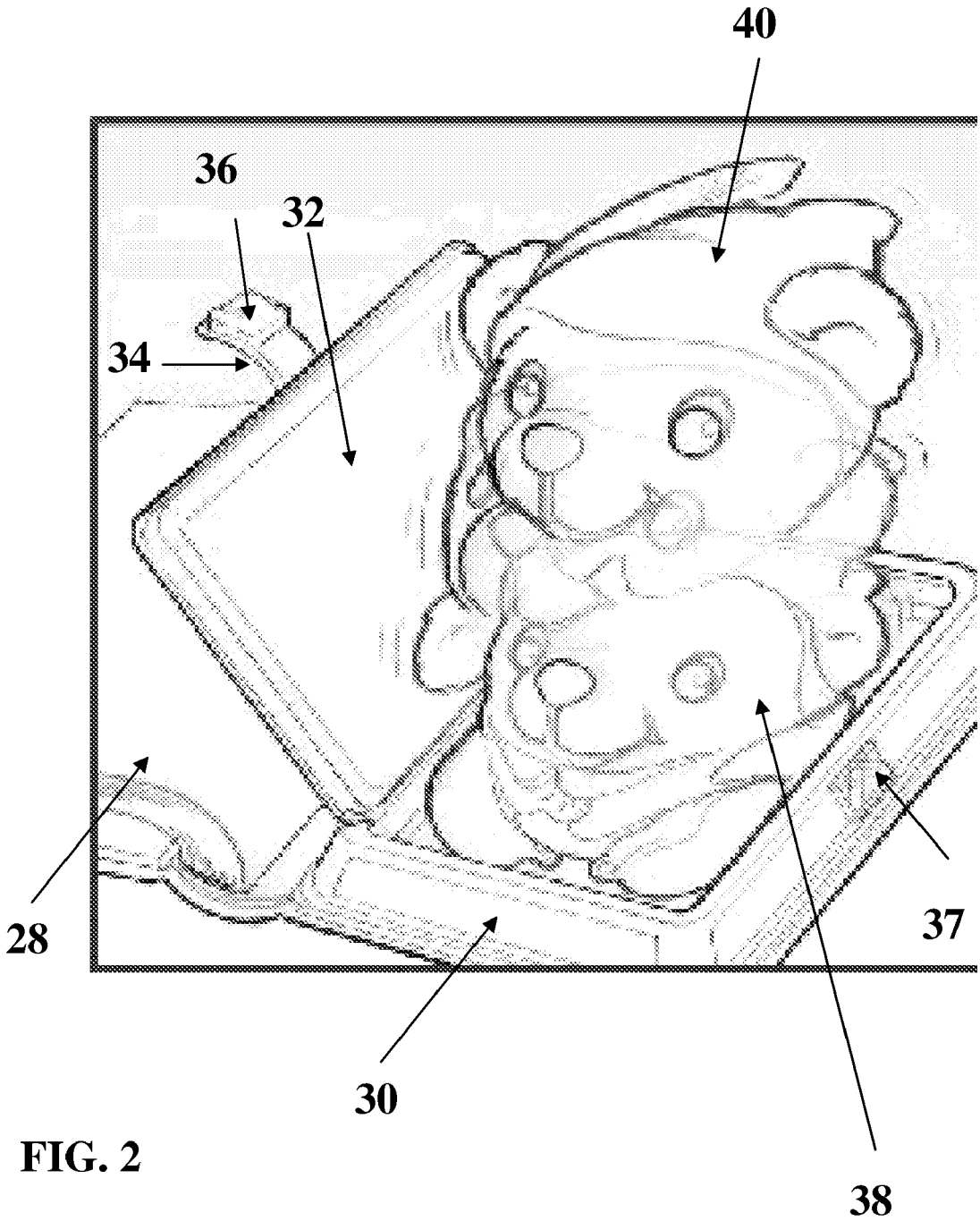
FIG. 2 illustrates a housing in one of the books being opened and a compressed foamed object expanding into a figure.

Referring to FIG. 2, the last page 28 has been turned and a closeable housing 30 is visible to the reader. The housing 30 is preferably found on the back cover of the book, but can be found in any number of locations, including the front cover or any of the pages in the book.

The housing 30 has a strap 34 that is used to close the door 32 to the housing 30. The strap 34 preferably, but not necessarily, has a piece of Velcro 36 that attaches to a matching strip of Velcro 37 on the housing to keep the door 32 closed. When it is desired to open the door 32, the strap 34 is lifted to separate the Velcro strips 36 and 37. The locking mechanism can also be an injection molded strap. The strap can be molded as part of the door 32 and a receptacle for receiving a part of the strap 34 can be molded into the housing 30. The injection molded strap is preferred when the compressed strength of the object is great. Any other type of locking mechanism can be used. For example, a locking clasp similar to those found on pocketbooks can also be used.

Inside the housing 30 is an object 38 preferably made of compressible foam, such as a low density, flexible, open cell foam plastic material. Polyurethane is an example of such a material. The object can be made in accordance with the compressible foam figures explained in U.S. Pat. Nos. 6,575,807, and 5,897,418, all of which are hereby incorporated by reference. The object 38 can also optionally have a spring in it which is in a loaded position when the object 38 is compressed.

When the door 32 is closed, the object 38 is in a compressed state. When the door 32 is opened by a reader, the compressed foam object expands from state 38 to state 40. When the object 40 has completely expanded, it assumes a figure that can be a toy. It can also be decorated to reflect a character that is related to the contents of the book. This will allow the reader of a book, particularly a child, to have greater enjoyment, interest and anticipation while reading the book.

Figure 3:
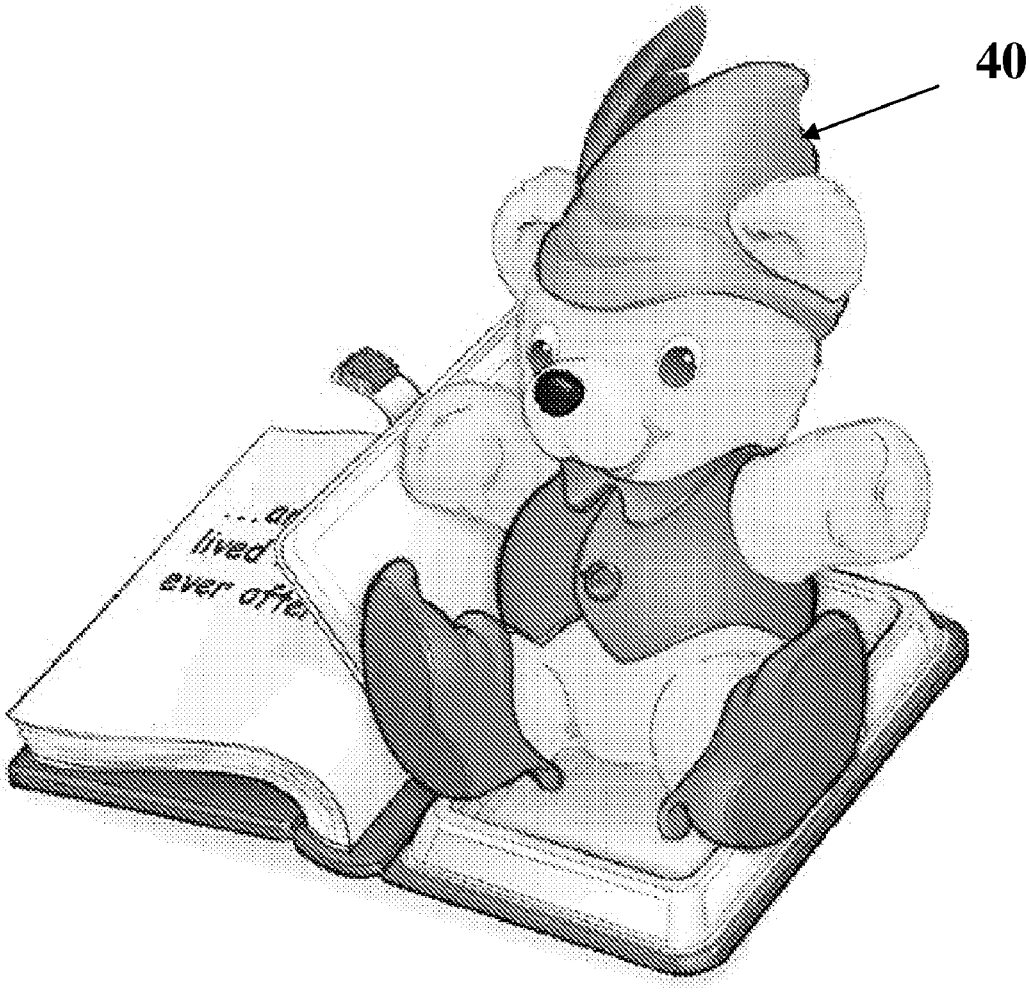
FIG. 3 illustrates the figure after the housing is opened.
Figure 4:
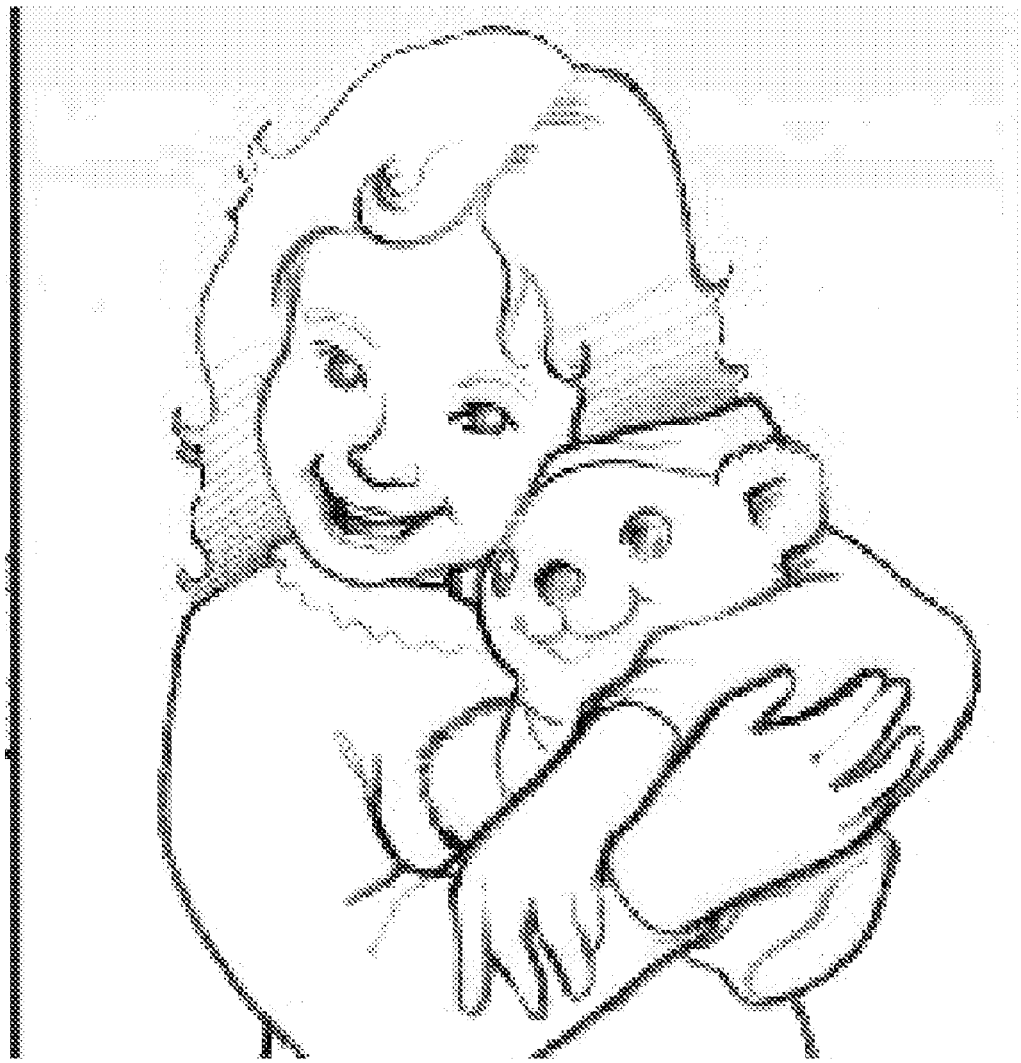
FIG. 4. illustrates the figure removed from the housing and the book in accordance with one aspect of the present invention.

FIG. 3 illustrates the FIG. 40 is a fully expanded shape. The FIG. 40 can be removed from the book and held by a child who has just read the book, as illustrated in FIG. 4.

While there have been shown, described and pointed out fundamental novel features of the invention as applied to preferred embodiments thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

The invention claimed is:

1. An article comprising:

a book;

a closeable housing closed by a strap and disposed within a back cover of the book, the housing having a door that opens into an interior of the book; and an object made of a compressible and expandable foam, in a compressed state in the housing;

wherein the object expands into a figure when the housing is opened.

2. The article as claimed in claim 1, wherein the book has one or more characters and the figure is representative of one of the one or more characters.

3. The article as claimed in claim 1, wherein the strap has Velcro on it.

4. The article as claimed in claim 1, wherein the housing is decorated with a picture related to a content of the book.

5. The article as claimed in claim 1, wherein the object includes a spring that is loaded when the object is in the compressed state.

6. A method, comprising:

reading a book with a closeable housing closed by a strap, the housing being located in a back cover of the book and having a door that opens into an interior of the book; and a compressed object made of compressible and expandable foam in the closeable housing;

opening the closeable housing by releasing the strap; and expanding the compressed object into a figure.

7. The method as claimed in claim 6, further comprising removing the figure from the book.

8. The method as claimed in claim 6, wherein the figure is related to a character in the book.

* * * * *